US005526558A

United States Patent [19]

Caley, Sr.

[11] Patent Number: 5,526,558

[45] Date of Patent: Jun. 18, 1996

[54] METHOD OF USING AN ARTICULATED PIPING CONNECTOR

[76] Inventor: A. Paul Caley, Sr., 36 Barnes Rd., Ossining, N.Y. 10562

[21] Appl. No.: 314,321

[22] Filed: Sep. 28, 1994

Related U.S. Application Data

[62] Division of Ser. No. 51,622, Apr. 22, 1993, Pat. No. 5,373,617.

[51] Int. Cl.[6] ..... B25B 27/14

[52] U.S. Cl. ..... 29/402.08; 29/464; 29/468; 29/281.4; 29/281.5; 137/15

[58] Field of Search ..... 16/254; 248/289.1, 248/70, 71.1, 285; 285/23, 80; 403/12, 11, 72, 75, 160, 119; 269/45, 43, 71, 909; 29/271, 272, 281.4, 281.5, 402.08, 464, 468; 137/15, 316, 315, 317

[56] References Cited

U.S. PATENT DOCUMENTS

| | | | |
|---|---|---|---|
| 637,827 | 11/1899 | Quesenberry | 269/45 |
| 1,208,236 | 12/1916 | Thompson et al. | 285/80 |
| 2,991,070 | 7/1961 | Overton | 269/45 |
| 3,946,754 | 3/1976 | Cook | 137/15 |
| 4,461,284 | 7/1984 | Fackler | 269/45 |
| 4,532,688 | 8/1985 | Dewberry | 29/402.08 |
| 4,676,472 | 6/1987 | Kamrud | 248/74.1 |
| 4,856,741 | 8/1989 | Schaefer | 248/285 |
| 5,022,624 | 6/1991 | Hill | 248/289.1 |
| 5,303,481 | 4/1994 | Russell | 29/272 |
| 5,482,073 | 1/1996 | Winnie et al. | 137/15 |

*Primary Examiner*—Robert C. Watson

*Attorney, Agent, or Firm*—Brooks Haidt Haffner & Delahunty

[57] ABSTRACT

An articulated piping connector method facilitates installation of an in-line device such as a gas consumption meter to be supported by a gas supply pipe. The connector has two elongate rigid legs pivotable from a closed condition in which the legs are superposed to an open condition in which the legs are extended to support a meter or other device during installation. The legs have upstanding threaded members for connection to pipes and pipe fittings.

9 Claims, 4 Drawing Sheets

34
36
38
33a
37
P
33
35
37
36
39
33b 34
37
36
23
13
17
P
11
31
12
38
33a
25
27
33
39
33b

G
23
24
34
36
11
13
17
12
27
38
33a
G
35
36
33
39
33b

METHOD OF USING AN ARTICULATED PIPING CONNECTOR

This application is a division of application Ser. No. 08/051,622, filed Apr. 22, 1993, now U.S. Pat. No. 5,373, 617.

BACKGROUND OF THE INVENTION

The invention relates to a device for facilitating the installation of an in-line device such as a gas consumption meter on the ends of pipes which normally serve to support the device.

Meters, regulators and other devices are often installed in piping systems so that fluid flowing through the pipe passes through the device for measurement, regulation or other action with respect to the fluid. For example, the consumption of heating gas supplied to commercial and residential users is metered by utility companies by the interposition of a gas meter in the pipe that supplies gas to the user.

Typically, a gas supply line enters a residential consumer's house below ground level, and a gas consumption meter is installed in the consumer's basement. The gas supply piping is adapted to receive and support the meter above floor level by providing the piping with spaced, downturned, generally vertically disposed pipe sections terminating in open pipe ends to which spaced gas inlet and outlet openings of the meter are connected so that gas supplied to the consumer through the supply pipe must pass through the meter, which measures the volume of gas consumed by the user for heating, cooking or other purposes.

In cases where the user's gas consumption is relatively high, the gas consumption meters are large devices that can weigh as much as fifty pounds or more. Such large meters are bulky and meter installation is an awkward task, usually requiring the employment of two workers, one of whom lifts and holds the meter while the other worker secures threaded connectors at the inlet and outlet sides of the meter to the open gas pipe ends. When in place, the meter is suspended from the gas supply pipe.

The articulated pipe connector of the present invention makes it a simple Job for a single meter installer to put a meter in place without assistance.

SUMMARY OF THE INVENTION

At the location where a fluid flow meter, regulator or other device is to be installed in such a way as to be supported by a fluid conducting pipe, the pipe is interrupted by a gap, with the two open ends of the pipe spaced to accommodate the corresponding inlet and outlet connection fittings of the device. In the typical supply line for delivery of gas to a consumer the laterally spaced ends of the pipe at opposite sides of the gap in the piping are downturned and generally vertical, their ends lying in the same horizontal plane and having shoulder coupling rings and threaded coupling nuts thereon so that the threaded male inlet and outlet fittings at the top face of the gas meter can be butted upwardly against, and coupled to the downwardly facing pipe ends.

The two-piece piping connector of the invention facilitates the lifting and attachment of the meter or other device to these pipe ends. When connected, the two pieces provide a rigid, jointed support arm for temporary suspension of the meter during the task of connecting the meter to the pipe. The ends of each of the halves of the piping connector of the invention have respective male and female threaded connecting elements sized to respectively interfit threadedly with the female coupling nut on one of the pipe ends and the male threads on either of the gas meter inlet or outlet fittings. Thus at one end of one half of the piping connector there is an upstanding post with male threads of the same size so as to simulate the threaded male fitting on the meter inlet or outlet for coupling this half of the connector to one of the gas pipe ends by means of its threaded female coupling nut. At the other end of the other half of the piping connector there is a downwardly facing unthreaded post having a shoulder ring providing a peripheral flange at its downwardly projecting end which collars a threaded female coupling nut thereon, of the same size so as to simulate one of the gas pipe coupling nuts, for coupling this half of the connector to the meter.

The piping connector halves are removably and pivotably connectable to each other. In the preferred embodiment the connection device comprises an upstanding unthreaded pin on the connector half which is to be attached to one of the pipe ends, and a corresponding and upstanding cylindrical sleeve on the other connector half for slidably fitting over the pin on the first half and for pivoting thereon. When not in use, the two halves of the piping connector can be conveniently mounted on each other and closed to a condition in which the halves are disposed one atop the other so that the interfitting male and female threaded ends of the fittings thereon can be coupled together for easy storage and handling of the piping connector.

When a gas meter is to be installed, the installer connects the male threaded post at one end of one of the halves of the connector to one of the gas supply pipe ends, then connects the other connector half to the meter by screwing the downwardly facing female threaded collar coupling on that half on to one of the upstanding short piping segments provided on the inlet or outlet orifices of the meter for connection to the gas line. The meter is lifted, and the aperture and cylindrical sleeve at the projecting free end of its connector half is mounted for pivotal movement on the vertical pin on the projecting or distal end of the connector half which is appended to the one gas supply pipe end. The meter is then swung horizontally on the connector into a position wherein its other free, inlet or outlet fitting lies beneath the end of the other gas supply pipe end, the horizontal swinging movement being provided by pivoting the meter on the two connector halves which now bear the weight of the meter. This free inlet or outlet fitting of the meter is then connected to the second gas supply pipe end. The piping connector halves are now removed from both the meter and the first gas supply pipe end, and the other of the inlet or outlet fittings of the meter is moved to beneath the now open first gas supply pipe end, by pivoting the meter horizontally, the meter being meanwhile supported by the gas pipe end to which the meter has already been secured. The second pipe end coupling connection is made, and the meter installation is complete.

The respective legs or halves of the connector have respective vertically offset portions by which the supported and pivoted meter will be positioned having the tops of its threaded inlet and outlet male fittings, which themselves lie within the same plane, within the plane of the exposed bottom ends of the downwardly turned gas pipe ends to which they will be coupled.

The meter may be demounted using the two-piece connector in a reverse procedure, as will be apparent. That is, the couplings on both pipe ends are loosened; one of the inlet or outlet ends of the meter is decoupled from the gas supply pipe end to which it is attached; the meter is pivoted horizontally on the other pipe end connection to expose this inlet or outlet end; the piping connector half having the downwardly facing coupling thereon is coupled to the now exposed fitting on the meter; and the connector halves are then connected and the male fitting on the other half is connected to the now exposed gas supply pipe end so that the full weight of the meter will be supported thereon via the articulated piping connector of the invention. The other meter fitting is now disconnected from the other pipe end, and the meter may now be lifted off from the connector half which is coupled to the first pipe end. Thus, one man may remove the meter without assistance, as will be understood.

Although the invention is described with respect to the installation of a gas consumption meter, other applications, such as the installation of regulators or other devices in fluid conducting piping, the temporary support of an in-line device for inspection and repair and the like will suggest themselves.

The piping connector of the invention will be more fully understood when the following detailed description of a preferred embodiment is read in conjunction with the accompanying drawing figures, in which like reference characters designate like parts.

DETAILED DESCRIPTION OF A PREFERRED EMBODIMENT

Figure 1:
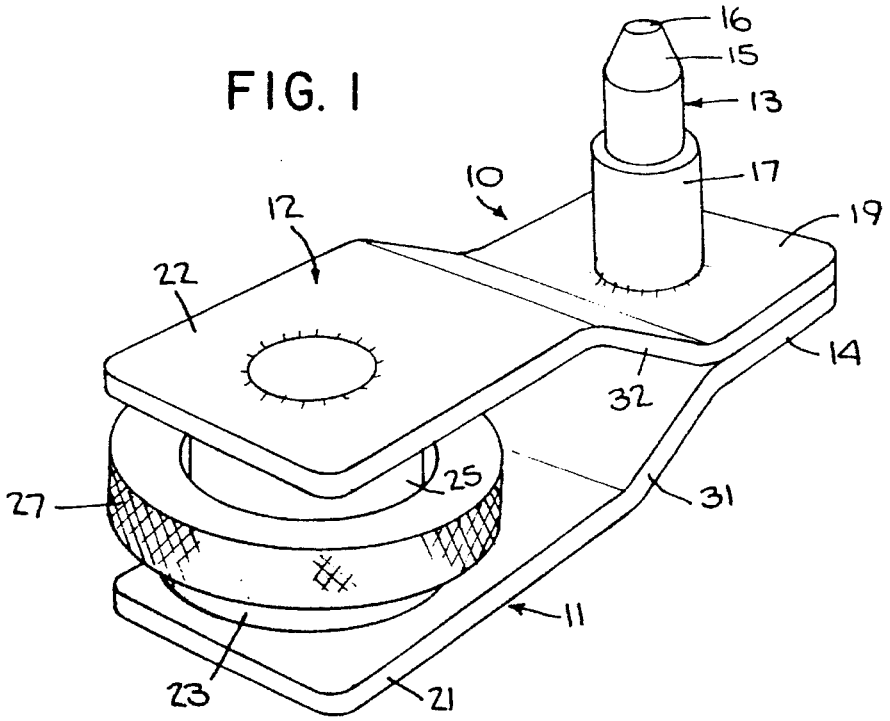
FIG. 1 is a view in perspective of the articulated two-piece piping connector of the invention in assembled and closed condition.
Figure 2:
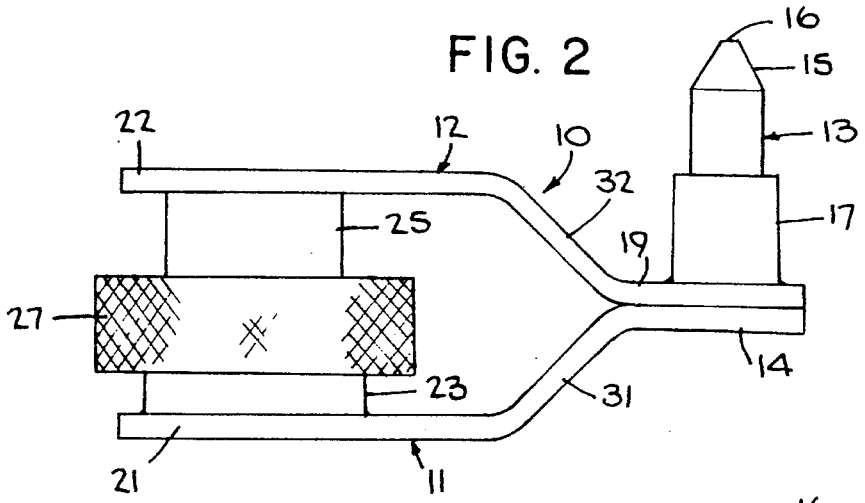
FIG. 2 is a side view of the articulated piping connector of FIG. 1.
Figure 3:
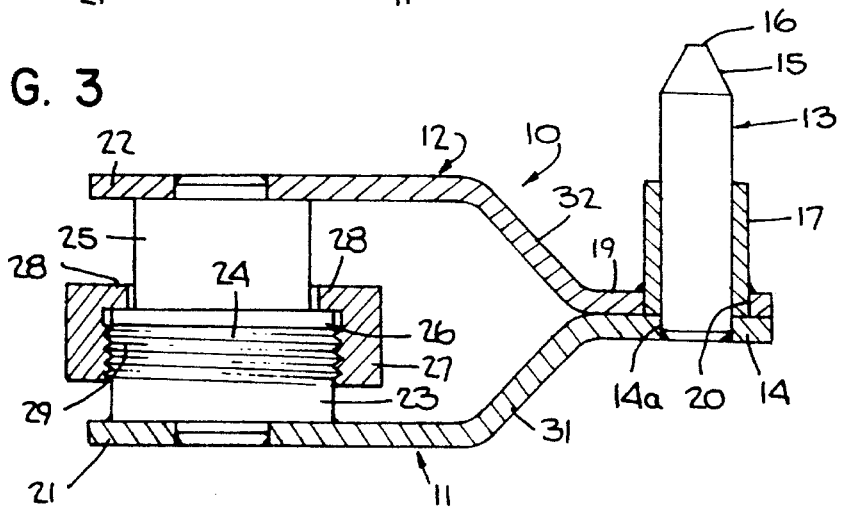
FIG. 3 is a side view in section of the articulated piping connector.

The two-piece articulated piping connector of the invention, generally designated by the reference numeral 10, is shown in its assembled and closed condition in FIGS. 1–3, with the elongated and rigid halves or legs 11 and 12 positioned one on and above the other. A pin 13 is welded or otherwise secured to a flat end portion 14 at one end of the underlying leg 11 and stands upright, perpendicular to its leg end portion 14. In the embodiment shown, the pin 13 is welded within a corresponding aperture 14a of the leg as seen in FIG. 3. The pin 13 preferably has a generally conical tip portion 15 tapering to a blunt or flattened point 16 to facilitate its receiving of the sleeve 17 of the other leg 12, as will be described.

The other leg 12 of the connector 10 has an upright tubular cylindrical sleeve 17 welded or otherwise mounted on and surrounding a corresponding aperture 20 through a flat end portion 19 of the leg 12, for pivotable reception of the pin 13 on the underlying leg 11, which is closely but slidably received in the sleeve 17 for pivotal movement with respect thereto.

Flat end portions 21 and 22 of the legs 11 and 12, respectively spaced from the end portions 14 and 19, carry respective threaded fittings for their respective connection to either a gas pipe end or a meter or other device to be supported.

In the case of the leg 11, the threaded fitting is a stout, upstanding cylindrical post 23 firmly secured, as by welding, to the flat end portion 21. The upper portion of the post has external threads shown at 24 in FIG. 3 so that, as will later be described, the threaded post 24 simulates a threaded fitting on the gas inlet or outlet of the meter. The flat end portion 22 of the other leg 12 also carries a vertically disposed, but downwardly facing cylindrical post 25, which is attached as by welding to the end portion 22. The post 25 is somewhat smaller in diameter than the post 23. The post 25 terminates in a circumferentially extending collar or projecting flange 26 best seen in FIG. 3.

A rotatable coupling ring 27, preferably having a knurled outer surface for easy gripping, is carried by the post 25. The ring 27 has an inwardly extending flange 28, best shown in FIG. 3. The flange 28 defines an aperture having a smaller diameter than the annular lip 26, but larger diameter than the post 25, so that the coupling ring 27 cannot fall off the post 25, but can slide vertically on the post 25. The diameter and internal threads 29 of the coupling ring 27 correspond with those of either of the gas supply pipe ends as will be later explained, and also mate with those of the male threads 24 on the post 23 when the connector 10 is in the closed condition of FIGS. 1–3. In this condition, when the two halves 11 and 12 are assembled by sliding the sleeve 17 on the pin 13, the two legs 11 and 12 can be fixed in position with respect to each other by a few turns of the threaded coupling ring 27 on the threaded post 23. This allows the connector 10 to be carried conveniently by a worker and prevents misplacement of either of the two portions of the connector when it is not in use. Clearly, for the connector 10 to be able to assume the closed condition of FIGS. 1–3, the legs 11 and 12 must be equal in length from their pivot axis at the pin 13 to the centerlines of their respective posts 23 and 25.

The leg 11 has its flat end portions 14 and 21 interconnected by a downwardly angled portion 31, in direction away from the bottom of its pin 13, and the flat end portions 19 and 22 of the leg 12 are interconnected by an upwardly angled portion 32, in the direction of extension of the sleeve 17. Thus, the end portions 14 and 19 are intended to engage one another, while the end portions 21 and 22 are vertically offset or spaced from each other by a vertical distance sufficient for the coupling 27 to be threadedly engaged on the post 23 so that the connector 10 assumes its closed condition of FIGS. 1–3, i.e., a distance equal to about the combined heights of the posts 23 and 25 when the flat leg portions 19 and 14 are interfaced with one another.

The angled portions 31 and 32 respectively are shown disposed at an oblique angle to the flat end portions of the legs 11 and 12 respectively but, if desired, the portions 31 and 32 could be disposed at right angles with respect to the end portions they serve to connect. Whatever the angular relationship of the end portions 14 and 21 to the portion 31 and of the end portions 19 and 22 to the portion 32, the flat end portions of the legs 11 and 12 are parallel to each other as shown when the two halves of the connector are joined together.

It is presently preferred that all of the elements of the piping connector 10 be made of stainless steel, because of the considerable bending force imposed on the elongated legs 11 and 12 of the connector 10 which serve as support bars when the connector supports the weight of a device such as a gas consumption meter, as will be described. However, other rigid materials such as polyvinyl chloride could be employed, and all of the posts and sleeve of the connector 10 need not be made of the same material. In particular, the posts 23 and 25 need not be of solid cylindrical material as shown, but could be sturdy cylindrical pipe sections, if lightness of weight of the connector 10 is desired. Although the surface of the coupling ring 27 is shown as knurled for ease of manual rotation by a worker, the coupling ring could have a plurality of flat faces like a nut. Also, the relative dimensions of the elements comprising the connector could be varied, although it is preferable that each of the legs 11 and 12 have length equal to about one-half the width of the meter or other device to be mounted, and that the pin 13 be sufficiently long to prevent separation of the parts 11 and 12 during use of the connector 10.

Figure 4:
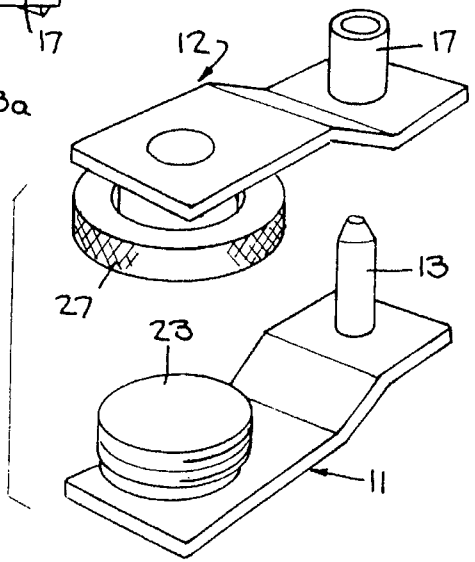
FIG. 4 is a perspective view of the articulated piping connector of the invention with its two halves separated one from the other.

When the piping connector 10 of the invention is to be put to use, the two parts 11 and 12 of the connector are separated, as shown in FIG. 4, by unscrewing its coupling ring 27 from its post 23 and sliding the pin 13 out of the sleeve 17.

Figure 11:
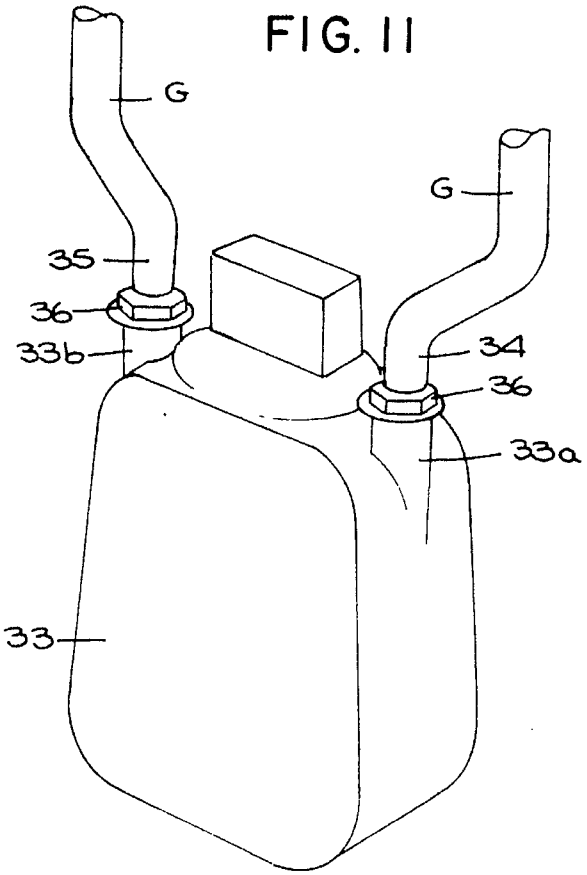
FIG. 11 illustrates a gas consumption meter as typically installed.

The remaining FIGS. 5–12 of the drawings illustrate the use of the two-piece articulated piping connector 10 in the installation of a gas consumption meter 33 in a gas supply pipe of the type employed for providing heating gas to a residential consumer. When in service, the gas consumption meter 33 is connected to the downturned, generally vertically disposed lower pipe ends 34 and 35 of a breached gas supply pipeline, generally indicated by the reference character G. When the meter is installed, the pipeline G usually supports the full weight of the meter 33 which hangs from the pipe ends 34 and 35 as shown in FIG. 11.

The gas piping G can typically have an internal diameter of about 1½ inches and an outer diameter of about 1¾ inches. The downturned piping end segments 34 and 35 lie in the same horizontal plane P and are each equipped with a rotatable coupling nut 36, held on the respective pipe ends 34 and 35 by radial collars or flanges 37 which can be seen in FIG. 12.

The meter 33 has horizontally spaced, vertically extending threaded male fittings 38 and 39 respectively at its gas inlet and outlet openings 33*a*, 33*b* for the flow of gas through the meter for measurement. The fittings 38 and 39 are short pipe segments with external threads by which the meter 33 is secured to the ends 34 and 35 of the gas piping G as shown in FIGS. 11 and 12, the male fittings 38 and 39 accepting the internal threads of the respective collar nuts 36, which are vertically slidable on the pipe ends 34 and 35, when the meter is connected.

Figures 5, 7, 12:
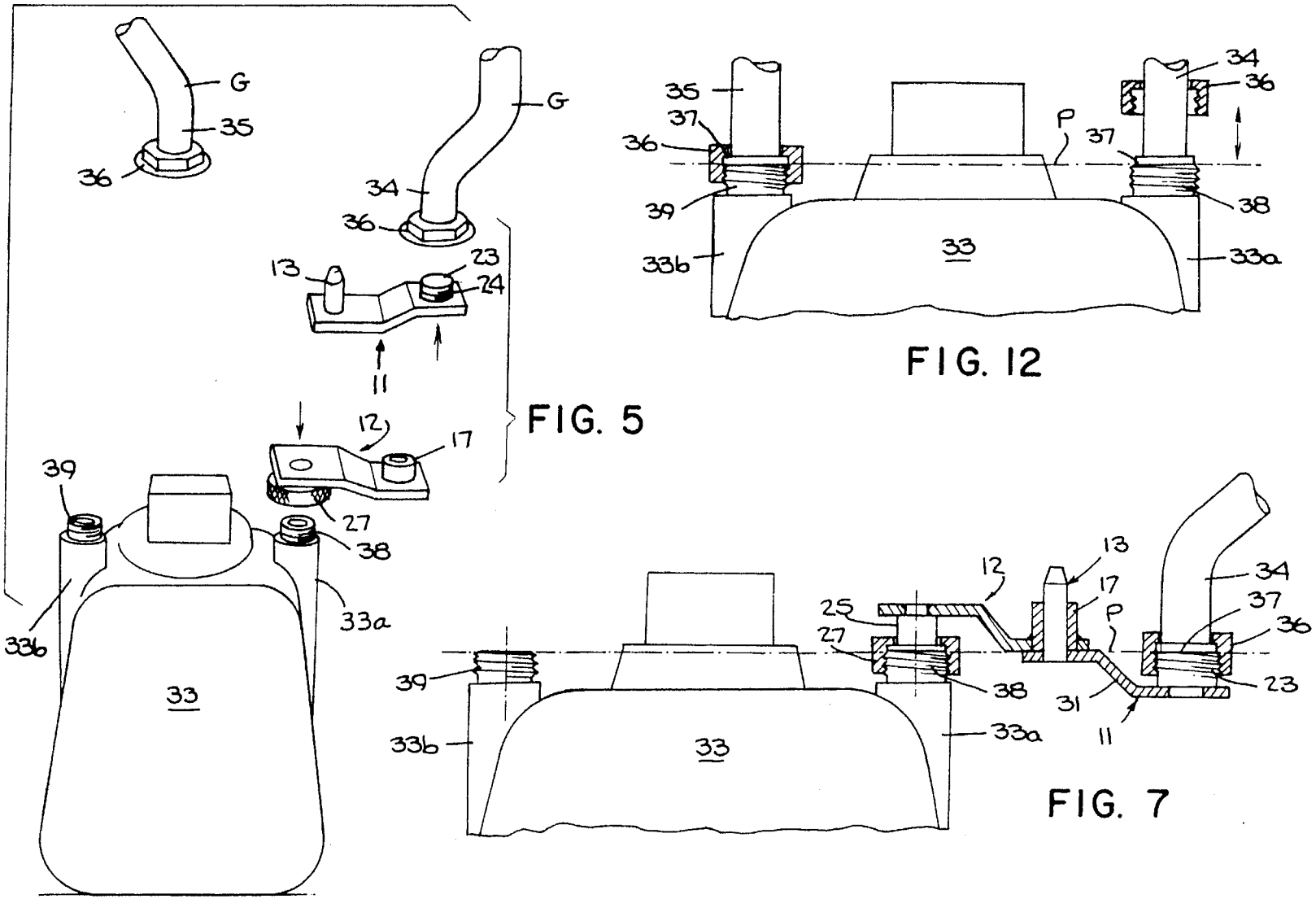
FIG. 5 illustrates the two halves of the piping connector and their respective initial relationships to a gas consumption meter and gas supply piping.
FIG. 7 is a view, partially in section, showing a meter supported by the articulated piping connector in the first stage.
FIG. 12 is a partly sectional view of an installed gas consumption meter.

Starting from the condition shown in FIG. 5, an installer attaches the upper leg 12 of the connector 10 to a fitting 38 of the meter 33 by screwing the connector coupling ring 27 on to the threads of the fitting 38. The installer attaches the other leg 11 of the connector to the corresponding gas supply pipe end 34 to which the meter fitting 38 will ultimately be attached, by screwing the pipe end collar nut 36 on to the threads 24 of the connector leg post 23. This connection is not fully tightened, thereby permitting its pivotal movement at a later stage during the installation.

The installer lifts the meter 33 with the connector leg 12 thereon, and brings the sleeve 17 of the leg 12 and its corresponding circular aperture 20 to a position above the pin 13. He then lowers the meter to bring the sleeve 17 down into pivotal seating relation on the pin 13 of the other connector half 11, which is coupled to the pipe end 34. The weight of the meter 33 is now fully supported by the pipe end 34 through the pivotally connected halves of the connector 10 as shown in FIG. 7. The installer no longer needs to hold up the meter 33, which would require the use of both hands because of the weight and bulkiness of the meter. When the connector 10 is supporting the meter 33, the now pivotally connected rigid legs 11 and 12 act as a single support bar for the meter.

Figure 8:
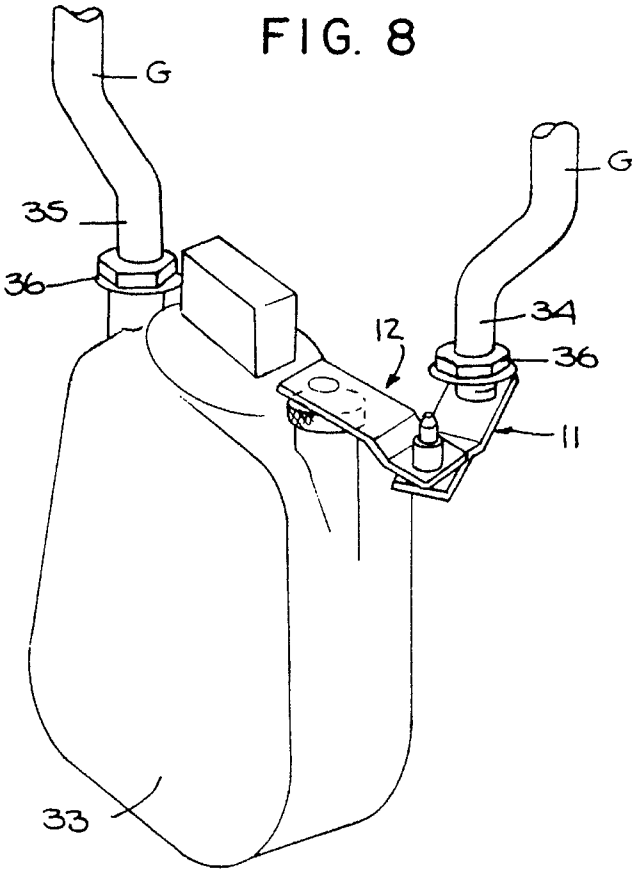
FIG. 8 shows a sequential stage in the installation of a meter at which one part of the meter has been connected to one of the gas supply pipe ends.
Figure 6:
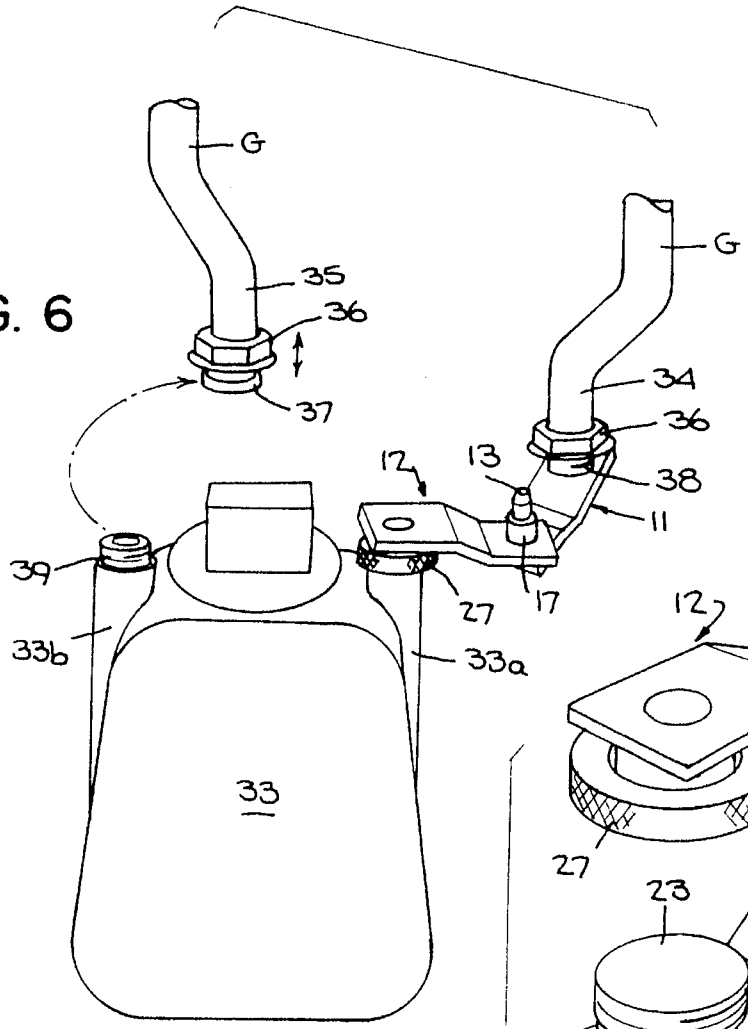
FIG. 6 shows the first stage of installation of a gas consumption meter with the aid of the articulated piping connector of the invention.

In the next step, the installer pivots the meter 33 horizontally, swinging it towards the other pipe end 35 as shown in FIG. 6, the movement being accompanied by pivoting of the legs 11 and 12 with respect to each other on their pivotal connection at the post 13 and sleeve 17, and perhaps by some pivoting of the connector leg 11 on the pipe end 34, to move the top end of the meter fitting 39 horizontally within the plane P into position for connection in alignment with and immediately beneath the coupling ring 37 on the pipe end 35. The fact that the nut 36 on the gas supply pipe 34 is not screwed tightly onto the post 23 permits the leg 11 to pivot with respect to the pipe end 34 as it continues to support the meter 33, so that the gas outlet 33*b* is easily moved to beneath the gas supply pipe end 35. The offset, oblique portions 31 and 32 together ensure that the top end of the meter fitting 39 will virtually abut the downwardly facing the bottom end of the pipe 35, the pipe collar 36 being lifted on the pipe 35 to permit the interconnection between these ends. The installer then screws the collar nut 36 of the pipe end 35 on to the external threads of the threaded fitting 39 on the outlet 33*b*, so that the meter condition with respect to the gas supply pipe ends 34, 35 is as shown in FIG. 8.

Figure 9:
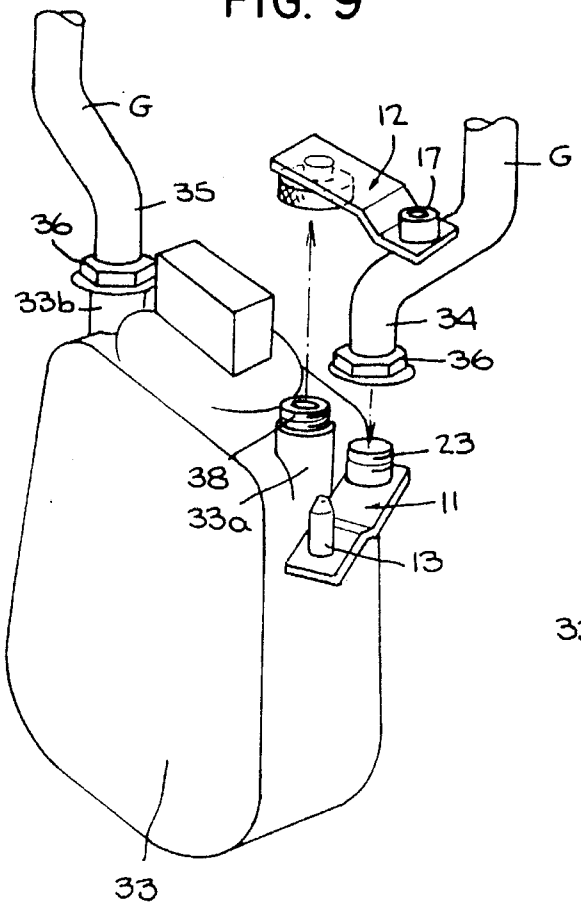
FIG. 9 illustrates still a further sequential stage of meter installation, following that of FIG. 8, during which the two halves of the articulated piping connector are removed from the meter and pipe end, respectively.

The articulated piping connector 10 can now be removed entirely, in the manner shown in FIG. 9, i.e., by unscrewing its rotatable coupling ring 27 on the leg 12 from the threaded gas meter inlet fitting 38, lifting the leg 12 off from the leg 11 at their post and sleeve connection 13, 17, and then unscrewing the coupling 36 on the supply pipe end 34 from the post 23 on the connector leg 11. The pipe end 34 is then free to receive the meter fitting 38 for coupling attachment.

Figure 10:
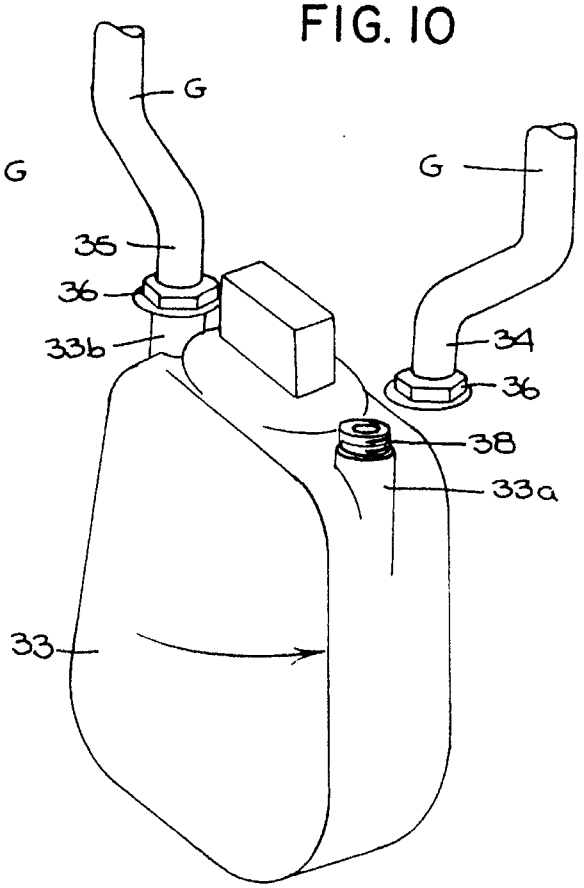
FIG. 10 illustrates the penultimate stage in the installation of a gas consumption meter.

The installer then swings the meter horizontally as shown in FIG. 10, pivoting it on the threaded connection 36, 39 at the meter outlet end 33*b*, to a position wherein the top end of the threaded meter inlet fitting 38 is immediately beneath the collar nut 36 on the pipe end 34, whereupon the collar nut 36 is screwed on to the fitting 38. It is due to the oppositely directed, offset relationship of the leg portions 31 and 32 that the top of the meter fitting 38 is moved horizontally within plane P to immediately below the coupling ring 37 on the pipe end 34 for its attachment, as will be understood from FIG. 7. The meter 33 is now connected on line with the gas pipe line G as shown in FIG. 11. The installer completes the job by tightening the nuts 36 on the fittings 38 and 39 as illustrated in FIG. 12.

The fact that the connector 10 is formed of two relatively pivotable legs 11 and 12 allows meter installation in confined areas, as for example, when the meter is installed in a closet or cabinet.

When one man, working alone, wishes to demount the meter 33, he may do so by reversing the procedure. That is, he first loosens both pipe end coupling nuts 36 while the meter 33 is attached as seen in FIG. 12. He then disconnects the coupling 36 from the meter fitting 38 (FIG. 12), and pivots the meter 33 horizontally so that its fitting 38 moves within the plane P out from under the coupling ring 37 on the pipe end 34, lifting the coupling 36 to permit the movement. Because the connection has been loosened, the meter pivots at its fitting 39 with the coupling 36 on the opposite pipe end 35. He then attaches the connector leg 12 to the meter fitting 38 using the connector coupling nut or collar 27. The pin 13 of the other leg 11 is slid upwardly into the sleeve 17 on the leg 12, and its threaded male fitting 23 on its opposite end is connected to the free pipe end 34 using its coupling 36. The meter 33 is now fully supported by the connector 10, again as seen in FIG. 7, whereupon its opposite fitting 39 is disconnected from the opposite pipe end 35 by unscrewing its coupling 36. The meter 33 is pivoted on the connector 10 away from the pipe end 35, and its connected leg 12 is lifted off from the leg 11, the sleeve 17 sliding upwardly on pin 13. The meter 33 is thus demounted.

The articulated pipe connector 10 of the presently preferred embodiment of the invention can be used to facilitate the installation and demounting of such in-line devices as meters and regulators. Although the drawings show the suspension of a meter below a pipeline, the connector 10 of the invention could also serve in the installation of a meter or other device supported above a pipeline by the piping ends, or even laterally with respect thereto. Various other applications of the device of the invention will suggest themselves to those acquainted with the art.

What is claimed is:

1. A method of installing a device between the generally vertical, laterally spaced ends of two pipes, comprising coupling one end of a centrally articulated temporary support to a first pipe end, coupling the device to be installed to another end of said temporary support, connecting the device to a second pipe end, detaching the temporary support from the device and from the first pipe end, and connecting the device to said first pipe.

2. The method of claim 1 wherein the temporary support comprises two rigid, elongate support members which are pivotably interconnected, and including pivoting said support members with respect to each other during installation of said device.

3. A method of mounting a meter device or the like on a spaced apart pair of supports having respective coupling means thereon, said device having a spaced apart corresponding pair of coupling means for coupling to the respective of said support coupling means when said device is mounted on said pair of supports, said method comprising coupling a coupler on a first rigid leg of an articulated connector to one of said coupling means on said device, connecting a coupler on a second rigid but separate leg of said articulated connector to one of said support coupling means, separably and pivotably connecting said first and second legs of said connector together whereby said device is supported on one of said supports, pivoting said device with respect to said one of said supports to position the second of its said coupling means in alignment with the second of said supports, coupling together said second coupling means on said device and said second support coupling means, uncoupling said coupler on said first connector leg from said first coupling means on said device and uncoupling said coupler on said second connector leg from said first support coupling means, pivoting said device with respect to said second support to position its said first coupling means immediately adjacent to and in alignment with said first support coupling means and then coupling them together.

4. A method of demounting a meter device or the like from the respective couplings on a spaced apart pair of supports, said device having a corresponding pair of couplings respectively coupled to said support couplings, said method comprising loosening each of said couplings to permit pivotal movement, fully decoupling the coupling connection at one of said supports and pivoting said device on the other of said coupled connections to move its said decoupled coupler away from said one support, coupling a coupler on a first rigid leg of an articulated connector to said coupling on said one support, coupling a coupler on a second rigid leg of said articulated connector to said decoupled coupler on said device whereby said device is supported on said one support, fully decoupling the coupling connection at the other of said supports and pivoting said device on said articulated connector, and lifting said device to slidably separate its attached second rigid leg from said first rigid leg.

5. A method according to claim 4, wherein said pair of supports are spaced apart from each other in a lateral direction and each of said pivoting steps moves said device in said lateral direction.

6. A method according to claim 5, wherein said couplings on said pair of supports are disposed substantially within the same lateral plane.

7. A method according to claim 3, wherein said pair of supports are spaced apart from each other in a lateral direction, and each of said pivoting steps moves said device in lateral direction.

8. A method according to claim 7, wherein said couplings on said pair of supports are disposed substantially within the same lateral plane, and wherein said corresponding pair of coupling means on said device are spaced apart from each other in a lateral direction and substantially within the same lateral plane.

9. A method of mounting and demounting a meter device or the like on a spaced apart pair of supports having respective coupling means thereon, said device having a spaced apart corresponding pair of coupling means for coupling to the respective of said support coupling means when said device is mounted on said pair of supports, said method comprising coupling a coupler on a first rigid leg of an articulated connector to one of said coupling means on said device, connecting a coupler on a second rigid but separate leg of said articulated connector to one of said support coupling means, separably and pivotably connecting said first and second legs of said connector together whereby said device is supported on one of said supports, pivoting said device with respect to said one of said supports to position the second of its said coupling means in alignment with the second of said supports, coupling together said second coupling means on said device and said second support coupling means, uncoupling said coupler on said first connector leg from said first coupling means on said device and uncoupling said coupler on said second connector leg from said first support coupling means, pivoting said device with respect to said second support to position its said first coupling means immediately adjacent to and in alignment with said first support coupling means and then coupling them together, and thereafter loosening each of said couplings to permit pivotal movement, fully decoupling the coupling connection at one of said supports and pivoting said device on the other of said coupled connections to move its said decoupled coupler away from said one support, coupling said coupler on said first rigid leg of said articulated connector to said coupling on said one support, coupling said coupler on said second rigid leg of said articulated connector to said decoupled coupler on said device whereby said device is supported on said one support, fully decoupling the coupling connection at the other of said supports and pivoting said device on said articulated connector, and lifting said device to slidably separate its attached second rigid leg from said first rigid leg.

* * * * *